United States Patent [19]

Cronin

[11] 4,456,830

[45] Jun. 26, 1984

[54] AC MOTOR-STARTING FOR AIRCRAFT ENGINES USING APU FREE TURBINE DRIVEN GENERATORS

[75] Inventor: Michael J. Cronin, Sherman Oaks, Calif.

[73] Assignee: Lockheed Corporation, Burbank, Calif.

[21] Appl. No.: 370,760

[22] Filed: Apr. 22, 1982

[51] Int. Cl.[3] ..... F02N 7/08; F02N 11/04; F02N 17/00

[52] U.S. Cl. ..... 290/27; 123/179 B; 123/179 D; 123/179 AS; 290/32; 290/34

[58] Field of Search ..... 290/27, 32, 34, 40 R, 290/40 C, 43, 52; 123/179 SR, 179 AS, 179 B, 179 BG, 179 D, 179 E

[56] References Cited

U.S. PATENT DOCUMENTS 3,678,285 7/1972 Griffith ..... 290/40 R 3,764,814 10/1973 Griffith ..... 290/40 R

*Primary Examiner*—G. Z. Rubinson

*Assistant Examiner*—Shelley Wade

*Attorney, Agent, or Firm*—Louis L. Dachs

[57] ABSTRACT

The invention is an electric starting system for starting aircraft jet engines (32), (34) and (36) using an APU (10) free turbine driven generator (12). The operating power factor of the starter-generator (12) is controlled during start mode operation of the APU (10) by monitoring the line current via a current transformer (58). Contactors (14) and (16) connect the generator (12) into the aircraft's ac power system and ac starting system, respectively. A master start relay (22) is provided, and is closed in the 'start' mode such that a power electronics inverter (24) may be powered from external power via contactors (18). The variable-voltage/variable-frequency output of inverter (24) is controlled via a logic controller (26) and can be applied sequentially to the three engine driven generators (32), (34) and (36) via start relays (42), (44) and (46) to start the engines (32), (34) and (36) respectively. An alternative embodiment of the APU generator/power electronics/starter-generator start system is the utilization of a separate induction motor starter than can operate with or without the use of power electronics.

18 Claims, 2 Drawing Figures

FIG. 1
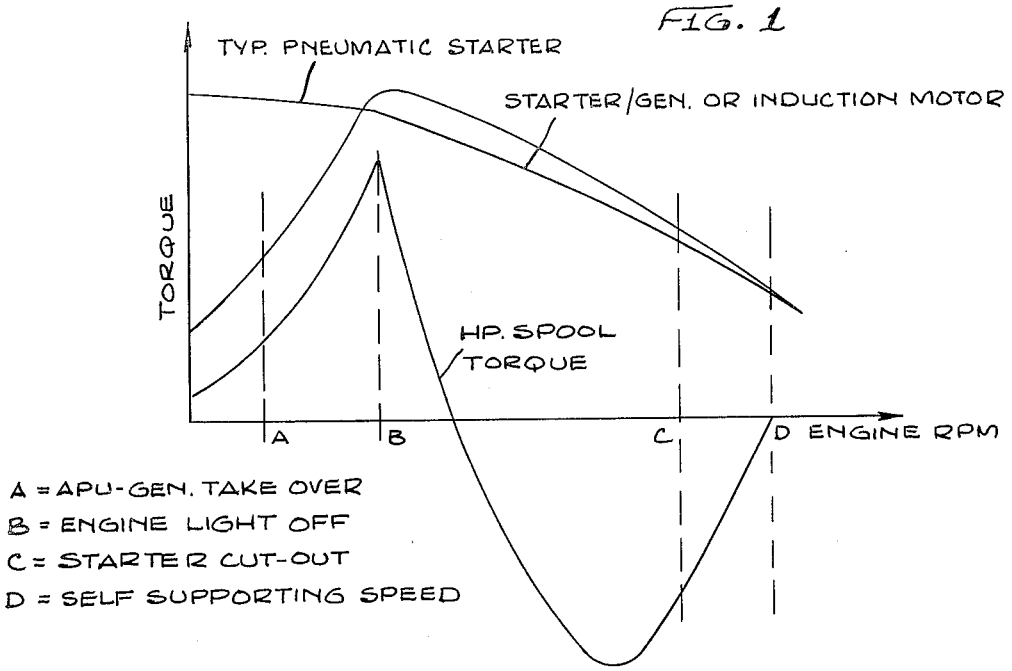
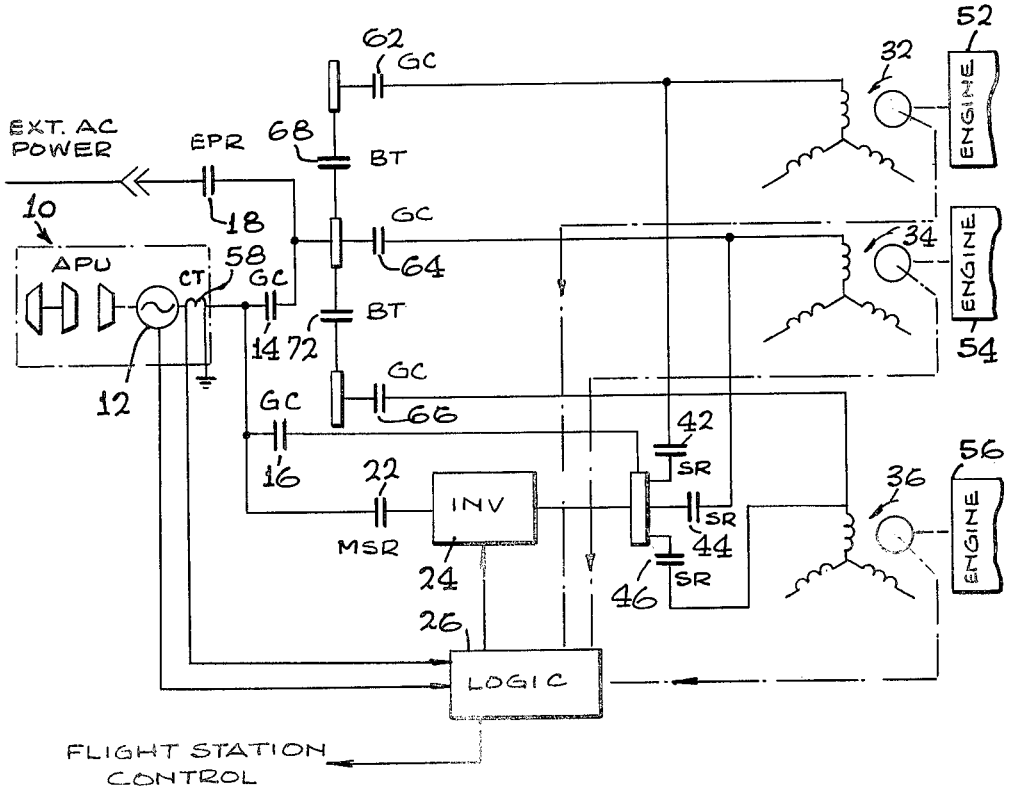
FIG. 2

AC MOTOR-STARTING FOR AIRCRAFT ENGINES USING APU FREE TURBINE DRIVEN GENERATORS

TECHNICAL FIELD

The invention relates generally to systems for starting aircraft jet engines, and in particular, to an electric starting system for starting aircraft engines utilizing auxiliary power unit driven generators.

BACKGROUND ART

In the past, starting of large aircraft jet engines has normally been accomplished with pneumatic starters, which derive their air energy from external power; for example from an auxiliary power unit (APU) or bleed air from another jet engine. With the advent of the all electric airplane, presently under consideration by the aircraft industry, ducting for subsystems such as the environmental control system is to be eliminated in the interest of saving weight. Moreover, one of the primary objectives of the all electric airplane is the elimination of engine bleed which of course eliminates cross-bleed engine starts. Thus the future development of advanced all electric type aircraft necessitates the development of efficient electric starting technology. Such a system not only would eliminate ducting and engine bleed, but would eliminate considerable investments in capital equipment in that under pneumatic start systems, pressurized and/or conditioned air has frequently had to be provided at airline gates or via carts and the like.

Recently, with the emergence of permanent-magnet (samarium-cobalt) generators, it has become possible to consider the operation of these generators as synchronous motor-starters. At least one corporation has conducted studies which show that the use of aircraft synchronous-generators as synchronous motor-starters is a viable alternative. In at least one study, a 150 kva samarium-cobalt generator was used and its operation in the start mode effected through a variable speed constant-frequency (VSCF) static power converter. The power converter in the "generator mode" changes the high variable frequency of the generator into 3 phase 400 Hz 200 VAC constant-frequency power for aircraft use.

In co-pending U.S. patent application Ser. No. 173,111, filed July 28, 1980, entitled "A Direct Driven Aircraft Generating System Providing Variable And Constant Levels Of Electric Power" (assigned to the assignee herein), a unique power generator system is described which makes direct use of the major part of the power developed by the generator. As a consequence, there is no large capacity static power converter in each power channel as there is in the above VSCF type power system. Rather, a separate "dedicated" inverter is provided. As described in another co-pending U.S. patent application, U.S. Ser. No. 183,079 for "Direct-Driven Generator System For Environmental Control System And Engine Starting", filed Sept. 2, 1980, and also assigned to the assignee herein, the separate "dedicated" inverter is used to produce a synthesized form of ac power which is impressed on the starter-generator in such a manner that, as the voltage and frequency of the synthesized ac wave is increased, the high pressure rotor of the engine is brought up to its "self-supporting-speed." In such a circumstance the power for engine starting can be derived from external power, an APU-driven generator or from another engine-driven generator.

One problem with the latter starting technique is that the "inverter" becomes fairly large in electrical capacity, size and weight when it is required to start large turbo-fan engines, such as the Rolls Royce RB 211 engine. Thus, present jet engine starting technology suffers from two basic limitations: (1) pneumatic start systems are fuel inefficient, heavy and require pressurized air, ducts, support apparatus, etc. incompatible with all-electric airplane technology, and (2) advanced technology electric engine start techniques involve high capacity large/heavy inverter/converters. The present invention obviates these problems by providing a new approach which utilizes a "free turbine" APU-generator system to start aircraft jet engines, in which the speed of the free turbine is controlled via "customized" APU controls.

There are several U.S. patents which relate generally to electric engine starting systems and controls and which are of general interest but which do not deal specifically with an APU-generator system and controls of the type taught by the instant invention. Typical of these are U.S. Pat. Nos. 3,753,002 to Jacobson, 3,764,815 to Habock, 3,772,526 to Alwers, 4,069,424 to Burkett, and 4,256,972 to Wyatt.

The '424 patent discloses a system which utilizes an electronic static power supply to power a "parking bus" to which multiple generator-sets may be connected to permit their continued motoring after their prime-movers have been shut down. The '002 patent discloses an ac motor-transfer system to permit large motors to be switched to a line-frequency bus without major perturbations to the system. Multiple motors can be individually-started and connected to the main bus.

Also of general interest are the disclosures in the '815 and '972 patents. In the '815 patent a basic starting system is disclosed which employs a static inverter and a generator used as a starting motor while the 1972 patent discloses a system for switching a motor bus to an auxiliary power source upon phase and frequency synchronization so as to provide a "non-interrupted" power changeover.

Finally, the '526 patent relates to a methodology for starting a gas turbine connected to a synchronous generator so that the turbine-generator set may be accelerated up to a point that it can be synchronized and connected to the main power lines. Auxiliary start means for the gas turbine are provided by a diesel engine or electric motor.

None of the aforementioned prior art disclosures (hereby incorporated by reference) are directed to a free turbine APU-driven generator system as disclosed herein for starting aircraft engines. Thus, there remains a need for a highly efficient and lightweight engine start system for use in starting jet engines, particularly for use with future high technology all-electric type aircraft.

From the foregoing, it can be seen then that it is a primary object of this invention to provide a novel aircraft engine starting system which utilizes APU free turbine driven generators.

It is also an object of the present invention to provide an AC motor starting system which utilizes "starting inverters" significantly down-sized from prior art "starting inverters."

A further object of this invention is to provide a turbine APU-generator aircraft engine start system which utilizes a nominally-low external power supply to support engine start, and which in particular can utilize external power cooperatively with the APU.

A still further object of this invention is to provide an aircraft engine starter system which improves engine starting characteristics.

DISCLOSURE OF INVENTION

The invention relates to a system for starting aircraft jet engines which utilizes a "free turbine" APU, in which the speed of the free-turbine is controlled via "customized" APU controls. The free-turbine is preferably directly connected mechanically to a wound-field type generator whose voltage and frequency are controlled approximately proportional to free turbine speed: a permanent magnet generator could also be used, but with certain characteristic limitations. In the start mode, as discussed hereinabove, a dedicated variable voltage/variable frequency output inverter is used to bring the high pressure spool up to a speed, where the auxiliary power unit generator can be synchronized and connected (electrically) to the starter-generator that is mechanically connected to the high pressure spool. At this point, further acceleration of the high pressure spool is controlled by accelerating the free turbine on the auxiliary power unit up to the self supporting speed of the engine.

During the start mode the operating power factor of the starter-generator may be controlled to unity or a slightly leading power factor by monitoring the line current via a current transformer and controlling the field excitation of the wound field machine on the APU. When the APU is not being used for engine starting, the free turbine runs at constant speed to ensure that the generator provides constant voltage/constant frequency power to the aircraft loads.

The novel features which are believed to be characteristic of the invention, both as to its organization and its method of operation, together with further objects and advantages thereof, will be better understood from the following description, taken in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF DRAWINGS

FIG. 1 is a curve of engine torque vs. engine speed, showing the characteristics of both a pneumatic starter and a starter-generator or induction motor type starter superimposed above torque/speed characteristics of the engine; and FIG. 2 is a schematic of the APU free turbine driven generator starting system of the present invention.

BEST MODE—PREFERRED EMBODIMENT OF THE INVENTION

Referring now to FIG. 1 there is represented therein the typical torque/speed characteristic of a prior art pneumatic starter, superimposed above the torque/speed characteristic of an aircraft engine. The difference between the starter-torque and the engine-torque is the torque used for acceleration of the engine; above "light off" (line (B), FIG. 1) the engine begins to contribute torque of its own.

FIG. 1 also includes a curve representing the torque/speed characteristic of a starter-generator programmed to follow such a characteristic. In accordance with the present invention the "power electronics" associated with the starter-generator are programmed to accelerate the engine only from zero rpm to the rpm denoted by line (B). Beyond that point, the free turbine powered generator of the present invention is responsible for accelerating the engine up to its self-supporting speed. Thus, the free turbine of the APU supplies the major part of the engine starting power demand, while the system inverter supplies only that lesser power and energy required to accelerate the engine to dotted line (B) rpm. With the starter system of the present invention the inverter permits "synchronous-locking" at very low rpm (which is not initially possible with the turbine generator) but at a higher power the free turbine driven generator is able to synchronize with the starter-generator and thereafter supply the major part of the power, required for engine starting.

A preferred embodiment of the present invention is depicted in FIG. 2. Shown therein is a schematic of an electrical configuration of a practical implementation of the novel starting method of the present invention for multi-engined airplanes. As depicted therein, an APU (10) free turbine driven generator (12) connects into an aircraft's three phase ac power system (shown single-line for simplicity reasons) via generator contactors (14), and into the ac starting system, via generator contactors (16). The APU driven generator (12) may comprise a permanent-magnet type generator, e.g., samarium-cobalt type, but in the preferred embodiment would comprise a wound-field type generator. External three phase ac power also connects into the aircraft's ac power generation system via the external power relay (18), and into the ac start system via the master start relay (22). When the master start relay (22) is closed, the (power electronics) inverter (24) may be powered from external power and its programmed variable-voltage/-variable-frequency output, which is controlled via the logic controller (26), can be applied sequentially to the three engine-driven starter-generators (32), (34), (36), via start relays (42), (44), (46) respectively. In the preferred embodiment the engine-driven generators (32), (34), and (36) are of the permanent-magnet type.

The logic controller (26) is fed input data from various sources, as for example manual inputs from the flight station, current sensing signals, voltage/frequency signals from the inverter (24)/APU generator (12)/the starter-engine driven generators (32), (34) and (36); (also rotor-position signals for these generators) and various signals from the aircraft's engines such as high pressure spool speed and turbine temperature.

The APU free turbine driven generator start system of FIG. 2 functions as follows: external power is used initially via the inverter (24) to accelerate each engine (52), (54), (56) up to about 5% to 10% high pressure rotor speed; at this point the free-turbine APU driven generator (12) is synchronized with the generator on the engine being started. When electrical paralleling is effected, the speed of the APU generator (12) (whose voltage and frequency have been previously adjusted, via the logic controller (26) to that of the engine-driven generator) is raised to a speed corresponding to the ground-idle or "self-supporting" speed. This point is indicated by line (D) on FIG. 1, while the APU-generator take-over point and the starter cut-out point are shown as lines (A) and (C) respectively. In the "start-mode," a current transformer (58), monitoring the APU generator line current, is used via the electrical logic to control the operating power factor of the starter-generator to unity or a slightly leading power factor.

To accomplish the sequential engine starts, electrical-interlocks are necessary to control the various relays: these interlocks are responsive to the commands from the flight station and from the logic controller (26). For example, to start engine (52), power is first applied through relays (18) and (22) to the inverter (24): at this time, contactors (14) and (16) are open. Using signals from the flight station, and transducer data from the generator (32), the output voltage, waveform and frequency of the inverter (24) are automatically programmed and applied to generator (32) via the start relay (42). The engine (52) therefore accelerates in compliance with the programmed voltage and frequency up to line (A) (FIG. 1); at that point, contactors (16) close and master start relay (22) opens. The APU generator (12) is now synchronized (paralleled) with starter-generator, (32) when the voltage, frequency and phase angle are correct, and the engine (52) is brought up to the point indicated by line (D) on FIG. 1 by raising the speed of the APU free turbine. Engine generator (32) is now able to assume its generating role, so the generator contactors (62) and start relay (42) and generator contactors (16) open. Note: The bus ties (68) and (72) are also open at this time.

Following the starting of engine (52), the same start sequence can then be applied to engines (54) and (56), by opening and closing the appropriate three-phase relays ((44), (46), (16), (22), (64), (66)) in the manner described hereinabove with respect to the starting of engine (52). When all engines are running, external power relay (18) will open, to isolate external power, and contactors (62), (64) and (66) will close and all start-related contactors and relays, (16), (22), (42), (44) and (46) will open.

When it is necessary for the APU-generator (12) to supply normal constant voltage/constant frequency power to the aircraft's power-buses (in lieu of external power), contactors (14), (68) and (72) will be closed, while contactors (62), (64), (66) and (18) will be open. During this mode of APU (10) operation, the output voltage and frequency of the APU generator (12) will be approximately twice the point (A) (line (D), FIG. 1) voltage/frequency values.

The output of the inverter (24) is "synchrophased" by a rotor-position sensor, not shown but located on each starter-generator; this sensor "commutates" the power electronics to control the voltage and frequency of the inverter until the back-emf from the starter-generator can fulfill the commutation function. With the synthesized rotating field established in the stator of each starter-generator (32), (34), (36) (by the power electronics) the program logic schedules a controlled rate of change of frequency and voltage to bring the starter-generator rotor up to the speed, where the starter-generator can be synchronized and paralleled with the APU turbine generator (12). This automatic generator-synchronizing technique need not be detailed since the procedure itself is well understood by those versed in the art and also is not the primary thrust of the present invention.

As an alternative embodiment, the power electronics and APU free-turbine generator teachings, of the instant invention, can be utilized in a similar fashion, as cooperative power supplies for an ac induction motor which may be used as a separate dedicated starter. The further advantage in this case is that there is no need for synchrophasing, or any necessity for a rotor position sensor to commutate the power inverter electronics. Rather, a low voltage and a low frequency could be applied to the motor at the beginning of the start cycle and the V/F ratio can then be increased, until the APU generator takes over as before. In such an arrangement, the control logic and the power characteristics of the inverter would be essentially the same. The main differences would be that a "straight" generator and a "straight" motor-starter would be mounted on the engine. Obviously, since the induction motor-starter would be "dedicated" only to the starting role, it would to this extent be an additional electric machine which would add weight to the aircraft. However, in an alternative embodiment, an induction motor-gearbox could be used to bring the high pressure rotor up to the APU generator synchronization speed without any power electronics. For this embodiment, the induction motor would be direct line switched or a 3 phase 400 Hz or other suitable external power source. Such an arrangement would allow an external low-capacity power source to initiate the engine start, while the APU free turbine generator would apply the major part of the starting power.

Starting of the jet engines (52), (54) and (56) as described herein by utilization of the APU free turbine driven generator system of the present invention carries with it several distinct advantages, including but not limited to the following:

(1) The starting inverter (24) can be significantly down-sized from the inverter proposed in the aforementioned co-pending patent application U.S. Ser. No. 183,079;

(2) The free turbine APU generator (12) provides the major role of starting, not the inverter;

(3) External power can be used cooperatively with the APU (10);

(4) A nominally low capacity (conventional) external power source can be used to support the engine start;

(5) The operational features of the power electronics and the APU generator are synergistically combined;

(6) Engine starting characteristics are improved;

(7) The inverter/converter (power electronics) could be supplied by on-board batteries and/or rectified 3 phase 200 V ac power;

(8) The engine mounted starter-generator operates in the dual role of a starter and a generator;

(9) The alternative use of an induction motor starter eliminates the need for special synchrophasing/synchronizing techniques;

(10) The alternative use of an induction-motor utilizes an electrical machine that is highly reliable, rugged, simple and low cost;

(11) The alternative use of an induction-motor starter could eliminate the need for power electronics and only requires low power to initiate the engine start cycle.

(12) If aircraft power requirements do not demand a large synchronous generator, then a smaller, lower cost generator can be used, i.e., large permanent magnet synchronous generators of the SmCo type are expensive and more difficult to build;

(13) The alternative approach of using a direct line switched induction motor starter could eliminate the need for power electronics completely.

It has been shown that in accordance with the present invention, a highly efficient and reliable aircraft engine starting system can be provided that utilizes the adjunct technologies of power electronics and a free turbine APU driven generator. The two technologies are synergistic in that the power electronics supplies that part of the engine start cycle that cannot be accomplished by the APU generator (at very low speeds), while the APU generator furnishes the major part of the power requirements for starting. In the alternative embodiment, an induction motor starter can be used, with or without the support of programmable power electronics.

It is apparent that there has been provided with this invention a novel Aircraft Engine Starting System Using APU Free Turbine Driven Generators which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. An aircraft ac motor starting system for starting at least one aircraft engine comprising:
- a free turbine auxiliary power unit;
- a generator arranged to be driven by said auxiliary power unit;
- at least one engine driven starter-generator arranged to be driven by each of said at least one aircraft engine, said at least one engine driven starter-generator being electrically interfaced with said auxiliary power unit driven generator; and
- a power electronics assembly electrically interfaced with said auxiliary power unit driven generator and said at least one engine driven starter-generator, said power electronics assembly being adapted to apply a power characteristic to said at least one engine driven starter-generator whereby the output of said power electronics assembly can be used to complement the output of said auxiliary power unit driven generator to start said at least one aircraft engine.

2. An aircraft ac motor starting system as in claim 1 wherein said power electronics assembly is adapted to start said at least one aircraft engine sequentially with said auxiliary power unit driven generator.

3. An aircraft ac motor starting system as in claim 2 wherein said at least one aircraft engine is a turbine-type engine having a high pressure rotor, said power electronics assembly being adapted to bring said high pressure rotor up to a speed that is a small predetermined percentage of its full speed, while said auxiliary power unit driven generator is adapted to accelerate said rotor from that low percentage speed up to its self-supporting speed.

4. An aircraft ac motor starting system as in claim 3 wherein the characteristic of the power applied to said at least one engine driven starter-generator is variable-voltage/variable-frequency in which the voltage is generated essentially proportional to frequency.

5. An aircraft ac motor starting system as in claim 3 wherein said power electronics assembly comprises an inverter and logic controller, said logic controller being adapted to receive signal inputs including line current signals, voltage/frequency signals from said inverter, said APU driven generator, and said at least one engine driven starter-generator, engine driven starter-generator rotor-position signals, and aircraft engine signals including turbine temperature and high pressure rotor speed.

6. An aircraft ac motor starting system as in claim 5 wherein said power chararteristic is programmed via said logic controller to control the acceleration rate of said at least one engine driven starter-generator and said at least one aircraft engine.

7. An aircraft ac motor starting system as in claim 6 including an electric power system having power lines connecting said aircraft motor-starting system with an external power source and the normal aircraft power generation systems, said electric power system being further arranged to be controlled by said logic controller and including a plurality of power contactors, associated with said power lines, APU driven generator, inverter, and at least one engine driven starter-generator.

8. An aircraft ac motor starting system as in claim 7 wherein said logic controller is adapted to program the output power characteristics of said inverter and to control said power contactors throughout the start cycle and into an engine running aircraft power generation mode.

9. An aircraft ac motor starting system as in any one of claims 1, 3, 5, 7, or 8 wherein the output of said power electronics assembly and said auxiliary power unit driven generator are adapted to be sequentially applied to start multiple turbine engines in said aircraft.

10. An aircraft ac motor starting system as in any one of claims 1, 3, 5, 7, or 8 wherein said auxiliary power unit driven generator comprises a wound field type generator and said at least one engine driven starter-generator comprises a permanent magnet type generator.

11. An aircraft ac motor starting system for starting at least one aircraft engine comprising:
- a free turbine auxiliary power unit;
- a generator arranged to be driven by said auxiliary power unit;
- at least one squirrel-cage induction motor arranged to initiate a start on at least one aircraft engine, said induction motor being electrically interfaced with said auxiliary power unit driven generator; and
- a power electronics assembly electrically interfaced with said generator and said at least one induction motor, said power electronics assembly being adapted to apply a power characteristic to said at least one induction motor whereby the output of said power electronics assembly can be used to operate cooperatively with the output of said APU driven generator to start said at least one aircraft engine.

12. A process of starting at least one aircraft turbine-type engine characterized by a high pressure rotor, said aircraft including:
- a free turbine auxiliary power unit;
- a generator arranged to be driven by said auxiliary power unit;
- at least one squirrel-cage induction motor arranged to drive said rotor of said at least one aircraft engine, said induction motor being electrically interfaced with said auxiliary power unit driven generator; and
- a power electronics assembly electrically interfaced with said generator, an external power source, and said at least one induction motor, said power electronics assembly including an inverter and being adapted to apply a power characteristic to said at least one induction motor through said inverter, comprising the steps of:

utilizing external power via said inverter to activate said induction motor and accelerate said rotor to a predetermined low speed, and discontinuing use of external power and simultaneously utilizing output power from said auxiliary power unit driven generator to accelerate said rotor from said low speed to its self-supporting speed.

13. A process of starting at least one aircraft turbine-type engine as in claim 12 wherein said predetermined low speed is in the range of about 5% to 10% of said self-supporting speed.

14. A process of starting at least one aircraft turbine-type engine characterized by a high pressure rotor, said aircraft including:

a free turbine auxiliary power unit;

a generator arranged to be driven by said auxiliary power unit;

at least one engine driven starter-generator being arranged to drive said rotor of said at least one aircraft engine and to be driven by each of said at least one aircraft engine, said at least one engine driven starter-generator being electrically interfaced with said auxiliary power unit driven generator; and a power electronics assembly electrically interfaced with said auxiliary power unit driven generator and said at least one engine driven starter-generator, said power electronics assembly being adapted to apply a power characteristic to said at least one driven starter-generator, comprising the steps of:

utilizing external power supplied to said power electronics assembly by said power lines to activate said at least one starter-generator and accelerate said rotor to a predetermined low speed, and discontinuing use of external power and simultaneously utilizing output power from said auxiliary power unit driven generator to activate said at least one starter-generator in its synchronous motor mode to accelerate said rotor from said low speed to its self-supporting speed.

15. A process of starting at least one aircraft turbine-type engine as in claim 14 wherein the operating power factor of said at least one starter-generator during operation in its synchronous-motor mode is controlled to unity or leading power factor to optimize the efficiency of the engine-start process.

16. A process of starting at least one aircraft turbine-type engine as in claim 14 wherein the V/F ratio is maintained nominally constant and the voltage is raised approximately linear with the frequency as the latter is raised to bring said high pressure rotor up to its self-supporting speed.

17. A process of starting at least one aircraft turbine-type engine as in claim 14 wherein said auxiliary power unit driven generator is synchronously-locked and electrically paralleled with said at least one starter-generator at said predetermined low speed.

18. A process of starting at least one aircraft turbine-type engine as in claim 14 wherein said power electronics assembly includes an inverter, and including the step of matching the frequency, voltage and phase angle of said auxiliary power unit driven generator to the output-frequency of said inverter at said predetermined speed, thereby replacing said inverter as the power source for said at least one starter-generator.

* * * * *